US005397958A

United States Patent [19]

Na

[11] Patent Number: 5,397,958

[45] Date of Patent: Mar. 14, 1995

[54] GETTER DEVICE AND INNER SHIELD FOR COLOR BRAUN TUBE

[75] Inventor: Seung-Ok Na, Seoul, Rep. of Korea

[73] Assignee: Samsung Electron Device Co., Ltd., Rep. of Korea

[21] Appl. No.: 904,834

[22] Filed: Jun. 26, 1992

[30] Foreign Application Priority Data

Jul. 2, 1991 [KR] Rep. of Korea ..... 91-10075

[51] Int. Cl.[6] ..... H01J 29/80

[52] U.S. Cl. ..... 313/402; 313/407; 313/479; 313/481

[58] Field of Search ..... 313/402, 407, 481, 553, 313/479, 560

[56] References Cited

U.S. PATENT DOCUMENTS 4,571,521 2/1986 Gallaro et al. ..... 313/402
4,622,490 9/1986 Benway ..... 313/407
4,771,214 9/1988 Takenaka et al. ..... 313/479

FOREIGN PATENT DOCUMENTS 62-272430 5/1988 Japan .

*Primary Examiner*—Donald J. Yusko
*Assistant Examiner*—Vip Patel
*Attorney, Agent, or Firm*—Majestic, Parsons, Siebert & Hsue

[57] ABSTRACT

Provided is an inner shield for a color braun tube, which enables to improve an inside vacuum state of the color braun tube by readily scattering barium (Ba) into the inner shield disposed in the color braun tube through an opening portion of the inner shield without being attached around an outside of the opening portion when barium is scattered. The inner shield for a color braun tube, has an opening portion through which barium is scattered into an inside of the inner shield disposed in the braun tube when a getter is heated by a high frquency, the opening portion being formed substantially in a shape of a bugle and projected in the getter-positioned direction, whereby barium is easily scattered into the inner shield through the opening portion without being attached around an outside of the opening portion when barium is scattered into the inner shield.

4 Claims, 3 Drawing Sheets

GETTER DEVICE AND INNER SHIELD FOR COLOR BRAUN TUBE

BACKGROUND OF THE INVENTION

1. Field of the Invention

The present invention relates to an inner shield arranged in a color braun tube for shielding an external magnetism or magnetic field such as an earth magnetism exerting a harmful influence upon a deflection of an electron beam, more particularly, to an inner shield for a color braun tube, enabling an inside of the color braun tube to be maintained in a higher vacuum state by scattering barium(Ba) contained on a getter into an inside of the inner shield easily in such a case that the getter disposed in an inside of the braun tube is heated by a high frequency.

2. Description of the Related Art

In general, as shown in FIGS.1 and 2, a surface of the inner shield 5' is provided with an opening portion 8' so that when the getter 6' is heated by the high frequency, barium (Ba) on the getter 6' can be scattered into the inner shield arranged in the color braun tube.

Upon heating the getter, barium is scattered within a range of a scattering angle as shown in FIG.1.

Accordingly, when the getter 6' is heated by the high frequency, a part of barium is not passed through the opening portion 8' and attached around the opening portion 8'.

Barium (Ba), therefore, can not absorb a suspension, oxygen, gas and etc. with any more. As a result, the internal vacuum state of the color braun tube is dropped undesirably, so that the quality of the color braun tube is deteriorated.

Moreover, barium attached around the opening portion 8' is peeled from the surface of the inner shield due to an external impact, for example, an external magnetic field. In this state, when an arc is occurred, it has a problem that the color braun tube may be blown up, and apertures of a shadow mask may be clogged up.

SUMMARY OF THE INVENTION

It is therefore an object of the present invention to provide an inner shield for a color braun tube, which enables to improve an inside vacuum state of the color braun tube by readily scattering barium (Ba) into the inner shield disposed in the color braun tube through an openning portion of the inner shield without being attached around an outside of the opening portion when barium is scattered.

To achieve the above object, the present invention provides an inner shield for a color braun tube, having an opening portion through which barium is scattered into an inside of the inner shield disposed in the braun tube when a getter is heated by a high frquency, the opening portion being formed substantially in a shape of a bugle and projected in the getter-positioned direction, whereby barium is easily scattered into the inner shield through the opening portion without being attached around an outside of the opening portion when barium is scattered into the inner shield.

With this construction, when barium is scattered by heating the getter using a high frequency, it can be perfectly scattered into the inner shield arranged in the color braun tube through the opening portion without being attached around the opening portion. Therefore, it is possible to further absorb suspension, oxygen and gas existing in the color braun tube and to be attached to inner walls of the color braun tube,thus it is possible to smooth the flowing of electrons to improve an inner vacuum state of the color braun tube.

Moreover, since barium is not attached around the opening portion of the inner shield, it is possible to prevent the color braun tube from being blown up owing to the arc of the electron beam.

The above and other objects and features of the present invention will be better understood in view of following description studied in conjunction with the drawings.

DETAILED DESCRIPTION OF THE PREFERRED EMBODIMENT

Hereinafter, a preferred embodiment of the present invention will be described in detail with reference to the accompanying drawings.

Figure 1:
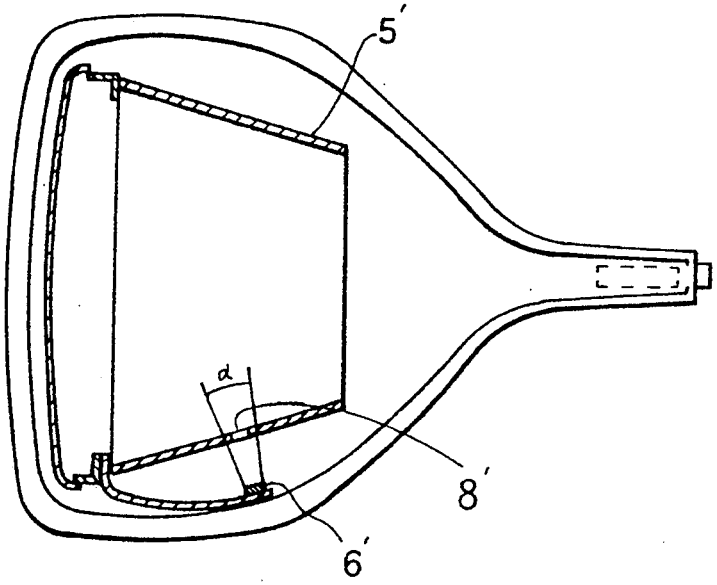
FIG. 1 (PRIOR ART)
FIG. 1 is a schematic view showing an internal construction of a color braun tube having a conventional inner shield disposed therein.
Figure 2:
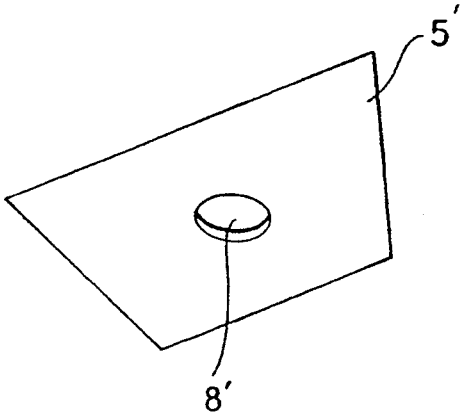
FIG. 2 (PRIOR ART)
FIG. 2 is a perspective view showing a portion of the conventional inner shield in FIG. 1.
Figure 3:
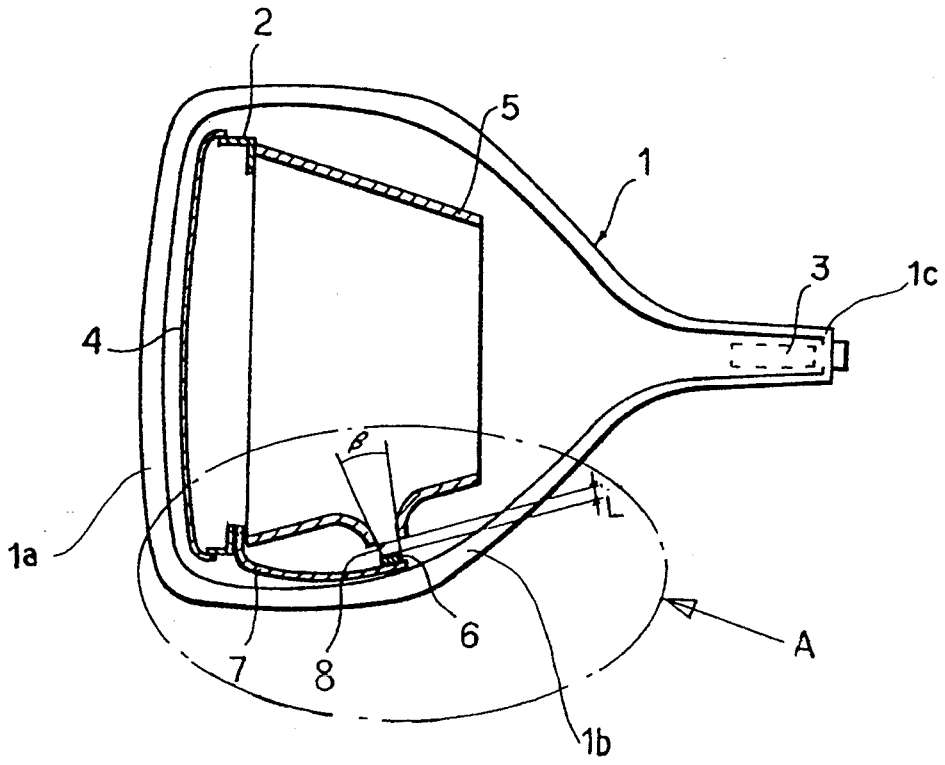
FIG. 3 is a schematic view showing an internal construction of a color bruan tube having an inner shiled according to the present invention.
Figure 5:
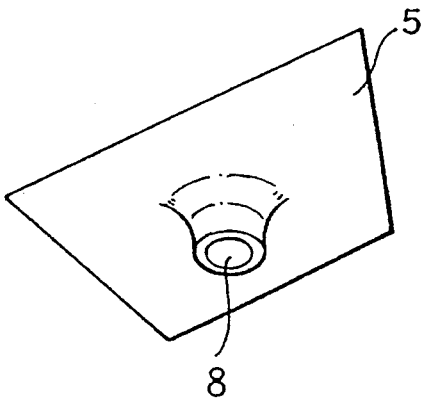
FIG. 5 is a perspective view of a portion of the inner shield according to the present invention.
Figure 4:
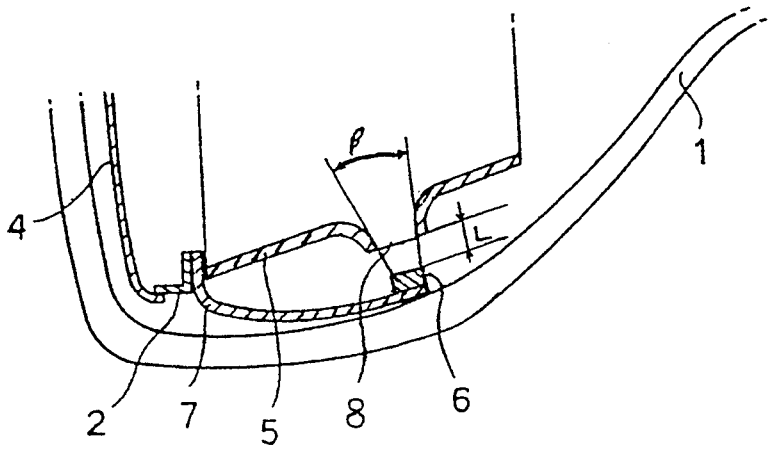
FIG. 4 is an enlarged cross sectional view of the part "A" in FIG. 3.

FIG. 3 is a schematic view showing an internal construction of a color bruan tube having an inner shiled according to the present invention, FIG. 4 is an enlarged cross sectional view of the part "A" in FIG. 3; and, FIG. 5 is a perspective view of a portion of the inner shield according to the present invention.

Referring to FIGS. 3 through 5, reference numeral 1 designates the color braun tube which comprises a pannel portion 1*a*, a funnel portion 1*b* and a neck portion 1*c*. The pannel portion 1*a* has a frame member 2 secured thereto by a reinforcement frame (not shown), and the frame member 2 has a section formed substantially in a shape of a latter "L". An electron gun emitting the electron beam is engaged to the neck portion 1*c*.

A shadow mask 4 is adhered to a side of the frame member 2. The shadow mask 4 has several hundred thousands of apertures for passing the electron beam emitted from the electron gun 3.

An end of a getter antenna 7 elongated in a shape of a letter "L" is secured to a predetermined position of a rear-side bottom of the frame member 2, while the other end of the antenna 7 is provided with the getter containing barium (Ba). Preferably, the getter antenna 7 is made of a thin plate material.

On the bottom surface of the rear side of frame member 2, that is, on the surface to which the getter antenna 7 is engaged, the inner shield 5 for shielding an external magnetism is fixed so that the external magnetism can not reflect the electron beam emitted from the electron gun 3 and advanced through the shadow mask 4.

Preferably, in consideration of a shield effect for the external magnetism, an area for forming the opening portion 8 is defined in a range within 20% of one surface of the inner shield 5.

It should be noted at this point that the opening portion 8 is projected up to a position having a distance L away from the getter 6 and is formed in a shape of a bugle so as to cover a range of the scattering angle $\beta$ as shown in FIG. 4. Herein,the distance L is within range of 20–100 mm, and the scattering angle is between 1.047–1.745 rad (60–100), preferably 1.221–1.57 rad (70–80). Also, when a value of $\beta/L$ is less than 0.05 rad/mm, barium is attached around the outside of the opening portion 8, such that a peeling danger of barium is increased, when the value of $\beta/L$ is more than 0.2 rad/mm (when both of distance and angle are large), a shield effet of the inner shield 5 is reduced.

Therefore, when the getter 6 is heated by a high frequency after the inner side of the color braun tube 1 is vacummized by an exhausting apparatus (not shown), barium can be scattered into the inside of the inner shield 5 arranged in the color braun tube 1 through the opening portion 8 without being attacted around the outside of the opening portion 8.

That is, barium is easily scattered to the inside of the inner shield 5. As a result, it is possible to further absorb the materials such as suspension, oxygen and gas existing in the color braun tube 1, and to improve the inner vacuum state of the color braun tube 1.

Moreover, since the size of the opening portion 8 is defined in a range within 20% of one surface of the inner shield 5, it is possible to shield the external magnetism easily.

As described above, according to the inner shield for the color braun tube, barium is scattered easily into the inside of the inner shield arranged in the color braun tube through the opening portion at the time of the barium scattering by way of the high frequency heating.

As a result, the inside of the color braun tube can be maintained in a higher vacuum state, so that a quality of the color braun tube can be improved. Moreover, since barium is not attached around the opening portion of the inner shield, it is possible to prevent the color braun tube from being blown up owing to the arc of the electron beam.

What is claimed is:

1. A getter device and inner shield for a color braun tube, comprising:

a frame member for securing a shadow mask for the color braun tube;

an inner shield positioned within the color braun tube for shielding an external magnetic field exerting a harmful influence upon a deflection of an electron beam;

a getter antenna attached at one end thereof to a side of said frame member;

a getter attached to the other end of said getter antenna for maintaining an inside of the color braun tube in a higher vacuum state by scattering at a scattering angle $\beta$ Barium contained on said getter into an inside of said inner shield when said getter is heated by a high frequency; and, an opening portion provided in a surface of said inner shield for receiving the Barium scattering from said getter, said opening portion being formed in a shape of a bugle and projected out from a flat portion of the inner shield to a position having a distance L away from said getter, wherein said distance L is within range of 20–100 mm, and said scattering angle $\beta$ is within range of 1.047–1.745 rad (60°–100°).

2. An inner shield for a color braun tube as claimed in claim 1, wherein a value of $\beta/L$ is between 0.05 rad/mm and 0.2 rad/mm.

3. The getter device and inner shield for the color braun tube of claim 1 wherein the scattering angle $\beta$ is within the range 1.221–1.57 rad (70°–80°).

4. The getter device and inner shield for the color braun tube of claim 1, wherein at least a part of the bugle shaped opening portion is substantially in the shape of a slice of a cone which would be formed by rotating a line which is at an angle of $\frac{1}{2}\beta$ from a center axis of the opening about this center axis, said opening section being such that it narrows as it approaches the getter.

* * * * *